United States Patent [19]

Boes et al.

[11] Patent Number: 4,617,450

[45] Date of Patent: Oct. 14, 1986

[54] PROCESS FOR MANUFACTURE OF A VACUUM-MOULDED ELECTRICAL HEATING UNIT

[75] Inventors: Josef Boes, Weilrod; Leo Saris, Nauheim, both of Fed. Rep. of Germany

[73] Assignee: Bulten-Kanthal GmbH, Morfelden-Walldorf, Fed. Rep. of Germany

[21] Appl. No.: 477,725

[22] Filed: Mar. 22, 1983

[30] Foreign Application Priority Data

Sep. 7, 1982 [DE] Fed. Rep. of Germany ..... 3233181

[51] Int. Cl.[4] ..... H05B 3/26

[52] U.S. Cl. ..... 219/345; 29/611; 29/613; 162/218; 162/353; 219/544; 219/546; 338/226; 338/252

[58] Field of Search ..... 338/226, 234, 235, 252–254, 338/275, 282, 296, 297, 301; 29/611, 613, 610 R; 219/345, 354, 390, 433, 436, 443, 459, 462, 464, 467, 521, 530, 544, 548; 264/87; 162/218, 353

[56] References Cited

U.S. PATENT DOCUMENTS

| | | | |
|---|---|---|---|
| 1,317,883 | 10/1919 | Meacham | 219/354 |
| 2,254,925 | 9/1941 | Wirth | 219/548 |
| 2,255,518 | 9/1941 | Norton | 219/546 |
| 2,489,190 | 11/1949 | Lelong | 219/546 |
| 2,674,775 | 4/1954 | Willson | 264/87 |
| 2,744,946 | 5/1956 | Lewicki | 219/548 |
| 3,275,497 | 9/1966 | Weiss et al. | 264/87 |
| 3,480,509 | 11/1969 | Stein | 162/353 |
| 3,500,444 | 3/1970 | Hesse et al. | 219/544 |
| 3,791,919 | 2/1974 | Schuller | 162/353 |
| 3,870,861 | 3/1975 | Werych | 219/459 |
| 3,952,408 | 4/1976 | Docx | 219/544 |
| 3,978,183 | 8/1976 | Erickson | 264/87 |
| 4,091,355 | 5/1978 | Beck | 338/286 |
| 4,247,979 | 2/1981 | Eck | 219/345 |
| 4,272,670 | 6/1981 | Docx | 219/390 |
| 4,278,877 | 7/1981 | Werych | 219/544 |

FOREIGN PATENT DOCUMENTS

| | | | |
|---|---|---|---|
| 1024181 | 7/1958 | Fed. Rep. of Germany . | |
| 2156361 | 5/1973 | Fed. Rep. of Germany | 29/613 |
| 2855382 | 6/1979 | Fed. Rep. of Germany . | |
| 3206508 | 9/1983 | Fed. Rep. of Germany . | |
| 2301148 | 9/1976 | France . | |
| 408267 | 12/1944 | Italy | 219/433 |
| 1441577 | 7/1976 | United Kingdom . | |

*Primary Examiner*—Clarence L. Albritton
*Assistant Examiner*—Geoffrey S. Evans
*Attorney, Agent, or Firm*—Oblon, Fisher, Spivak, McClelland & Maier

[57] ABSTRACT

A resistance heating coil is placed on a sieve like tray above a suction box, and a slip of ceramic fibers is placed in the suction box, so that a ceramic fiber layer builds up when suction is applied. Portions of the sieve like tray are closed in regions beneath the resistance heating coil by strips in such a manner that the impervious regions of the sieve like tray are narrower than the width dimensions of the heating coil so that the space inside the heating coil remains free of fiber material during the vacuum moulding operation. This allows the heater to be operated at a higher temperature without the risk of crystallization of the fibers.

6 Claims, 6 Drawing Figures

PROCESS FOR MANUFACTURE OF A VACUUM-MOULDED ELECTRICAL HEATING UNIT

BACKGROUND OF THE INVENTION

This invention relates to electric heating units and more particularly to such units in which coiled resistance heating elements are embedded in insulating bodies composed of ceramic fiber materials. The space inside the heating coil is essentially free of ceramic fiber material. A heating unit of this type is also designated as a heating module. In addition, and primarily, the invention relates to a vacuum-moulding process for manufacturing an electrical heating unit of this type.

DESCRIPTION OF THE PRIOR ART

The basic technique for vacuum-moulding electrical heating units, which will henceforth be termed "heating modules", is described, for example, in U.S. Pat. No. 3,500,444, and in a more modern form in U.S. Pat. No. 4,278,877. In heating modules which are manufactured according to this vacuum-moulding process, the heating spirals or heating coils are embedded in the ceramic fibre composition, in a manner such that the space inside the heating coils is, under normal circumstances, filled with fibre material.

SUMMARY OF THE INVENTION

According to the invention in one of its aspects, a vacuum-moulded electrical heating unit comprising a resistance heating coil embedded in an insulating body composed of ceramic fiber materials is disclosed, wherein the space inside the heating coil is essentially free of the ceramic fiber material.

According to another aspect of the invention, the freely radiating side of the heating coil is displaced backwards into the fiber block by spacing strips.

In accordance with the invention and another of its aspects, a vacuum-moulded electrical heating unit is made by applying adhesive strips to the under surface of the heating coils, placing these strips with the adhered heating coils onto a sieve-like tray, e.g., a perforated plate, introducing a slip containing a suspension of ceramic fiber into the frame, which is equipped with a sieve-like tray and drawing, by suction, the liquid from the slip to deposit a body of ceramic fibers around the circumference of the heating coils, thereby embedding the heating coils within the ceramic fiber insulating bodies, the space inside the heating coil remaining essentially free of the ceramic fiber material.

According to yet another aspect of the invention, the method of making the vacuum-moulded electrical heating unit includes the steps of attaching spacing strips to the sieve-like tray, beneath the positions which the adhered heating coils are to occupy. These spacing strips can be composed of metal, wood or plastic. When the slip is then introduced into the frame, and the suction applied, the heating coils do not fall out of the fiber block.

BRIEF DESCRIPTION OF THE DRAWINGS

In the text which follows, the invention and advantageous details, in the form of illustrative embodiments, are explained in more detail by reference to the drawings, in which.

In all the Figures, mutually corresponding parts are identified by the same reference numbers.

DESCRIPTION OF THE PREFERRED EMBODIMENTS

Figure 1:
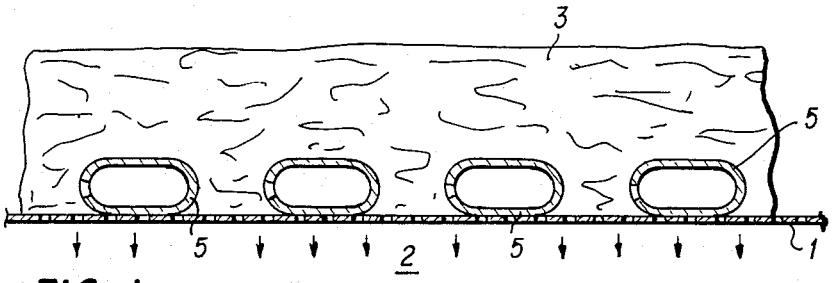
FIG. 1 PRIOR ART
FIGS. 1 and 2 show the state of the art, which has already been explained.

In order to explain the starting point for the invention, the conventional vacuum-moulding process is first described by reference to FIG. 1.

A heating coil 5 is placed on a sieve-like tray 1, for example on a perforated plate. A suction box, which is not represented, is located beneath the tray 1, through which box liquid is drawn off, by means of the vacuum which is indicated, generally, by the reference number 2, from a slip 3 which is poured on top, and which is composed of a solution of a binder, in water, containing ceramic fibres. The liquid constituents are drawn off, by suction, through the sieve-like tray 1, and a layer of ceramic fibres builds up.

In this conventional process, the space 8 inside the heating coil 5 is, as a rule, also filled with the ceramic fibres, and, moreover, the density in this interior space 8 will correspond to approximately the density of the remainder of the composition forming the ceramic fibre block 4, namely to approximately 200 kg/m$^3$.

Figure 2:
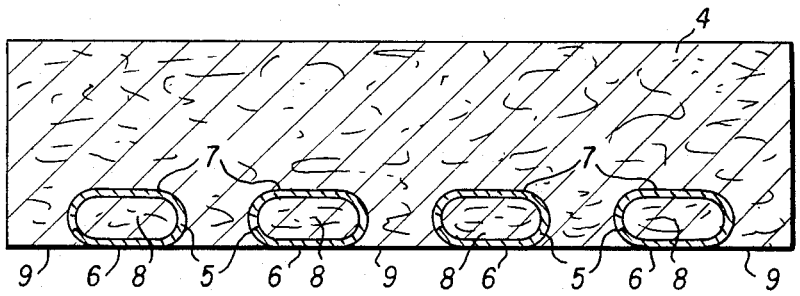
FIG. 2 PRIOR ART

The technical problems which arise in the course of using heating modules of this type are described in the text which follows, by reference to FIG. 2.

The surface zone of the heating coil is defined as the freely radiating surface region of the heating coil 6. When this freely radiating surface region of the heating coil is brought to an operating temperature of, for example, 1,150° C., a considerably higher temperature will occur on the opposite side (the rear side 7) of the heating coil 5, this rear side being completely embedded in the ceramic fibre composition. As a result, it is not possible to heat the heating coil 5, on its side 6 at which its surface radiates freely, to the operating temperature which is, at most, desired, since the rear side 7 would then be overheated. A problem which is associated therewith is concerned with the maximum possible use temperature or operating temperature of the aluminium silicate fibres which are quite predominantly employed for the fibre composition, these fibres being employed most frequently for economic reasons. More recent experience has shown that the maximum permissible operating temperature for such aluminium silicate fibres is approximately 1,150° C. Above this temperature, the fibres undergo excessive crystallisation, which leads to the complete loss of their structure and of the properties which are desired. If, now, the heating coil is raised to a temperature of 1,150° C. on the side 6 at which the surface radiates freely, the rear side 7 of the heating coil 5 can thus reach a temperature of approximately 1,250°

C. This temperature is then approximately 100° C. above the maximum permissible operating temperature of the fibres and will lead to excessively rapid recrystallisation of the fibre material. As a result, the heating coil 5 loses its grip in the overheated portion of the fibre composition and will detach itself, more or less quickly, from the fibres, above all in the case of roof-elements inside a furnace chamber. The heating coil 7 will then initially protrude more and more from the radiating side 9 of the fibre block 4, and will finally fall out.

The object underlying the invention is therefore to provide heating modules, of the type initially mentioned, together with a vacuum-moulding process for manufacturing them, as a result of which the anchoring of the heating coil, in the aluminium silicate fibre composition, is prevented from loosening, or from breaking down, even when the heating coil is heated to an optimum operating temperature, such that, for example, a temperature of 1,150° C. occurs at the radiating side of the module.

Other advantageous embodiments of the invention will now be described.

As a result of the invention, the space inside the heating coil remains more or less free of fibre material, so that the temperature difference at the heating coil, between the radiating surface of the heating module and the rear side, is considerably reduced, and the heating coil can, in its entirety, be operated at a markedly higher operating temperature, without incurring the danger of gradual loosening from the anchoring inside the fibre block.

Due to the fact that, during the vacuum-moulding process, spacing elements are placed beneath the heating coils, or the perforation of the sieve tray is relieved beneath the heating coils, that is to say is absent, the spacing elements or, as the case may be, the impervious regions of the sieve tray being narrower than the width measurements of the heating coils in a plane parallel with the radiating surface, or are narrower than the diameter of the heating coils, the result is obtained whereby the space inside the heating coils remains substantially free of fibre material, since it is obvious that the openings in the sieve-like tray are partially closed, during the vacuum-moulding operation, over the longitudinal extent of the heating coils, or are absent in these regions.

In a particularly advantageous embodiment of the invention, strip-like elements, hereinafter termed "spacing strips", are positioned beneath the heating coils, during the vacuum-moulding operation, so that, although the heating coils are exposed at the radiating surface of the heating module, for reasons which will be further explained below, they are nevertheless displaced, in their entirety, backwards into the fibre block, by a distance corresponding to the thickness of the spacing strips, so that optimum anchoring is obtained, while at the same time the space inside them remains free of fibre material.

Figure 3:
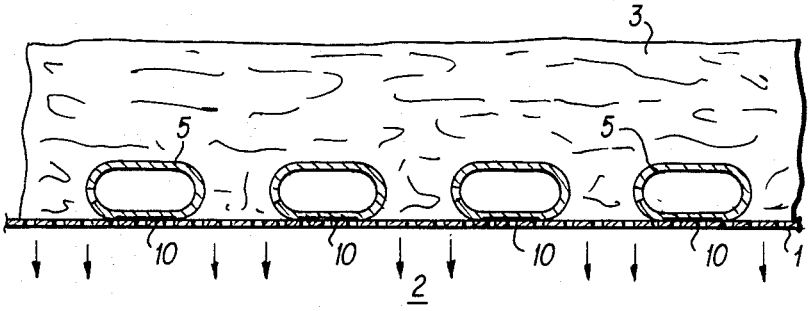
FIG. 3 shows a first illustrative embodiment, in order to explain the vacuum-moulding process according to the invention.

FIG. 3 illustrates the first embodiment. Strips 10 of adhesive tape are, for example, applied to the sieve-like tray 1 (the perforated plate), these strips covering the perforations over the longitudinal extent of the heating coils 5, that is to say in the direction perpendicular to the plane of the drawing. These strips 10 of adhesive tape are applied directly beneath the heating coils 5, which are subsequently placed on the perforated plate and lightly fixed. Due to the fact that some of the perforations are closed, the vacuum 2 produces no suction effect at these points, so that the space 8 inside the heating coils 5 remains free of ceramic fibre material to the greatest possible extent.

Figure 4:
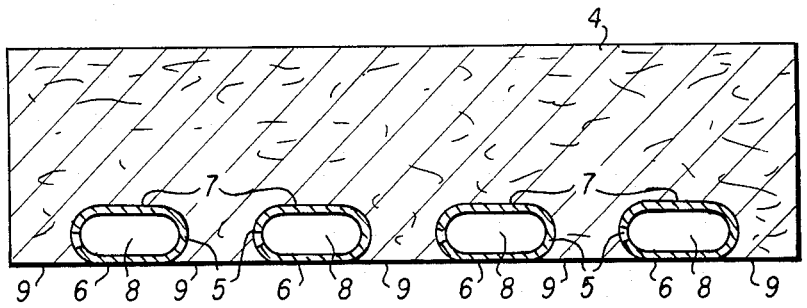
FIG. 4 shows, in a diagrammatic representation, the product resulting from the vacuum-moulding process according to FIG. 3.

The result of the manufacturing process explained by reference to FIG. 3 is shown in FIG. 4. Here too, the heating coil 5 lies flush with the radiating side 9 of the fibre block 4, in a manner similar to the arrangement in the case of the illustrative embodiment shown in FIG. 2. The space 8 inside the heating coils 5 is now empty, that is to say free of fibre material, so that the rear side 7 of the heating coils 5 can radiate considerably more freely. By this means, the result is obtained whereby the temperature difference at the heating coil, between the freely radiating side 6 at the radiating surface 9 and the rear side 7, is markedly reduced, thus avoiding undesirable overheating in the region of the rear side 7 of the heating coils 5.

However, this first, basic embodiment of the invention still possesses the disadvantage that the heating coil 5 is now less effectively bonded to the ceramic-fibre block 4, although the above-described recrystallisation effect, due to partial overheating, is no longer observed in the fibres. However, the heating coils 5 are surrounded by fibre material only along their outer periphery and, moreover, they are not held at the freely radiating side 6, as is also the case in the state of the art according to FIG. 2. Despite the fundamental advantage that the crystallisation of the fibre material no longer occurs, a further difficulty can, however, arise in the case of this design, due to the fact that, as a result of inadequate anchoring, the heating coils fall out of the fibre block, especially when this type of heating module is employed for roof-structures in furnace chambers.

Figure 5:
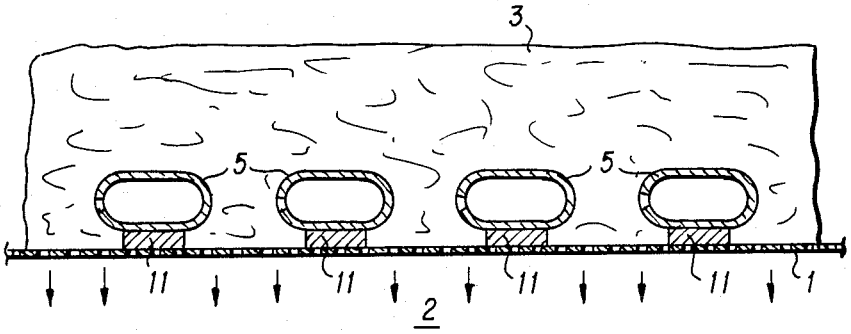
FIG. 5 shows an illustrative embodiment, which is to be preferred, of a vacuum-moulding process according to the invention.
Figure 6:
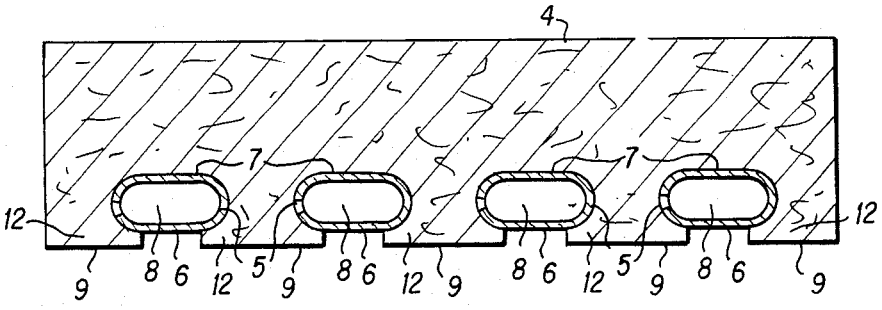
FIG. 6 shows, again in a diagrammatic representation, the product of the vacuum-moulding process according to FIG. 5, in order to explain certain advantageous properties.

The idea underlying the considerably improved embodiment of the invention, according to FIGS. 5 and 6, is to embed the heating coil 5 in the composition of the fibre block 4 in a manner such that, on the one hand, the space 8 inside it remains free of ceramic fibres, without, on the other hand, incurring the danger of the heating coils 5 being able to fall out of the fibre block 4, as the result of inadequate adhesion.

The principle underlying the manufacturing process is first explained by reference to the diagrammatic sectional representation shown in FIG. 5.

Spacing strips 11 are attached to the sieve-like tray 1, beneath the positions which the heating coils 5 are to occupy. These spacing strips 11 can be composed, for example, of metal, wood or plastic. The width of these spacing strips 11 should, in any case, be somewhat less than the diameter or, as the case may be, the width measurement of the heating coil 5 in a plane parallel with that side 9 of the fibre block 4 which forms the radiating surface, while the thickness of the spacing strips 11 should lie within the range from 0.1 mm, at the minimum, to approximately 30 mm, and preferably within the range from 2 to 10 mm. If now the slip 3 is introduced into the frame, which is not shown in more detail but is equipped with the sieve-like tray 1, and if the liquid constituents are drawn off through the sieve-like tray 1, the fibres accordingly build up in a manner such that the spacing strips 11 are surrounded, while the space for inside the heating coils 5 remains substantially empty, that is to say free of deposits of fibres.

FIG. 6 shows the resulting product, in a schematic sectional representation. The freely radiating side 6 of the heating coil 5 no longer lies flush with the radiating side 9 of the fibre block 4, but lies at a position which is displaced backwards into the fibre block 4 by a distance corresponding to the thickness of the spacing strips 11.

The retaining webs 12, resulting from the presence of the spacing strips 11, partially surround the freely radiating side 6 of the heating coils 5, but without the interior space 8 being filled with fibres. As a result, the desired objective was achieved, namely to keep the interior space free of fibres, so that the temperature difference between the radiating side 6 and the rear side 7 of the heating coils 5 is considerably smaller than in the case of the conventional technique, in which the heating coils are completely embedded in the fibre block 4, that is to say with the space 8 inside them filled by fibres. Moreover, on the other hand, the retaining webs 12 securely hold the heating coils 5, so that there is no longer any danger of their falling out, even when this type of heating module is used as a roof-element in a furnace.

As can be seen from the Figures, so-called oval heating coils or heating spirals 5 are provided in those embodiments of the invention which have been described, these coils, or spirals, being of the type which is also described in the abovementioned U.S. Pat. No. 4,278,877, with the advantages mentioned therein. A person skilled in the art can appreciate, without difficulty, that the invention can also be employed, with advantage, for heating coils possessing other cross-sections, for example possessing a round cross-section, or a cross-section which has been deformed into a rectangle.

What is claimed as new and desired to be secured by Letters Patent of the United States is:

1. A vacuum-moulding process for manufacturing an electrical heating unit, in which process a resistance heating coil is placed on a sieve-like tray, in a frame above a suction box, and a slip is introduced into the frame, this slip being composed of a slurry of ceramic fibers, a binder and water, such that upon the application of suction the ceramic fiber layer builds up under the action of the suction, this layer being cured, and containing the resistance heating coil as an embedded heating element, wherein those portions of the surface of the sieve-like tray which lie beneath the resistance heating coil are designed to be impervious to, and are narrower than, one of the group of maximum diameter and width of the heating coil in a plane parallel with the sieve-like tray, whereby the space inside the heating coil remains substantially free of fiber material during the vacuum moulding operation.

2. Vacuum-moulding process according to claim 1, characterized in that, in a preliminary operation, strips are placed on the sieve-like tray, at the positions of the heating coil, before the latter is inserted.

3. Vacuum-moulding process according to claim 1, characterized in that, in a preliminary operation, the strips are attached to the heating coil, on the side which is to face the sieve-like tray, their attachment being adhesive and easily releasable.

4. Vacuum-moulding process according to one of the preceding claims 1 to 3, characterised in that the strips are designed as spacing strips possessing a thickness of 0.1 to 30 mm.

5. Vacuum-moulding process according to claim 4, characterized in that the sieve-like tray is not perforated in those portions of the surface which lie beneath the heating coil.

6. Vacuum-moulding process according to claim 4, characterized in that said strips designed as spacing strips possess a thickness of 2 to 10 mm.

* * * * *